US009028339B2

(12) United States Patent
Doran

(10) Patent No.: US 9,028,339 B2
(45) **Date of Patent: *May 12, 2015**

(54) HYBRID GOLF CLUB HEADS AND HYBRID GOLF CLUBS INCORPORATING THE SAME

(71) Applicant: Mark Doran, Pawleys Island, SC (US)

(72) Inventor: Mark Doran, Pawleys Island, SC (US)

( * ) Notice: Subject to any disclaimer, the term of this patent is extended or adjusted under 35 U.S.C. 154(b) by 47 days.

This patent is subject to a terminal disclaimer.

(21) Appl. No.: 13/795,913

(22) Filed: Mar. 12, 2013

(65) Prior Publication Data

US 2013/0172101 A1 Jul. 4, 2013

Related U.S. Application Data

(63) Continuation-in-part of application No. 12/888,104, filed on Sep. 22, 2010, now Pat. No. 8,414,418, which is a continuation-in-part of application No. 12/250,722, filed on Oct. 14, 2008, now abandoned.

(51) Int. Cl.
*A63B 53/04* (2006.01)

(52) U.S. Cl.
CPC ..... *A63B 53/04* (2013.01); *A63B 2209/00* (2013.01); *A63B 2209/023* (2013.01); *A63B 53/0466* (2013.01); *A63B 53/047* (2013.01); *A63B 2053/0408* (2013.01); *A63B 2209/02* (2013.01)

(58) Field of Classification Search
CPC .. A63B 53/0466; A63B 53/04; A63B 53/047; A63B 2209/00; A63B 2209/023; A63B 2209/02; A63B 2053/0408
USPC ..... 473/324, 345–346, 349–350, 290–291
See application file for complete search history.

(56) References Cited

U.S. PATENT DOCUMENTS

| | | | | | |
|---|---|---|---|---|---|
| 4,420,156 | A * | 12/1983 | Campau | 473/291 |
| D301,907 | S * | 6/1989 | Muta | D21/750 |
| D329,481 | S * | 9/1992 | Hunt | D21/750 |
| 5,288,079 | A * | 2/1994 | Katayama | 473/328 |
| D442,245 | S * | 5/2001 | Roach et al. | D21/759 |
| 6,739,983 | B2 * | 5/2004 | Helmstetter et al. | 473/342 |
| 6,904,663 | B2 * | 6/2005 | Willett et al. | 29/557 |
| D559,932 | S * | 1/2008 | Belmont | D21/747 |
| 7,316,624 | B2 * | 1/2008 | Sanchez | 473/345 |
| 8,808,108 | B2 * | 8/2014 | Schweigert | 473/345 |
| 2003/0153399 | A1 * | 8/2003 | Woodward et al. | 473/331 |
| 2004/0106463 | A1 * | 6/2004 | Horwood et al. | 473/289 |
| 2007/0042837 | A1 * | 2/2007 | Bamber | 473/349 |
| 2007/0117651 | A1 * | 5/2007 | Belmont | 473/349 |
| 2010/0248860 | A1 * | 9/2010 | Guerrette et al. | 473/345 |
| 2014/0357400 | A1 * | 12/2014 | Schweigert | 473/324 |

* cited by examiner

*Primary Examiner* — Stephen Blau
(74) *Attorney, Agent, or Firm* — Dinsmore & Shohl LLP

(57) ABSTRACT

Hybrid golf club heads and hybrid golf clubs are described herein. The hybrid golf club head includes a body member having a hitting surface, a top surface, a toe end, a heel end, and a sole surface extending between the toe end and the heel end. The hybrid golf club head also includes a shaft attachment portion extending from the heel end upwardly and rearwardly therefrom away from the toe end, where the shaft attachment portion defines a shaft axis. The hitting surface is inclined at a predetermined angle with respect to the shaft axis. The hybrid golf club head includes a first Length B of the top surface near the shaft attachment portion and a second Length A of the top surface near the toe end, where the ratio of B to A is in a range from about 0.428 to about 0.75.

7 Claims, 4 Drawing Sheets

HYBRID GOLF CLUB HEADS AND HYBRID GOLF CLUBS INCORPORATING THE SAME

CROSS-REFERENCE TO RELATED APPLICATIONS

This application is a continuation-in-part of U.S. patent application Ser. No. 12/888,104, filed on Sep. 22, 2010, which is a continuation-in part of U.S. application Ser. No. 12/250,722 filed on Oct. 14, 2008.

TECHNICAL FIELD

The present disclosure relates to a golf club having a hybrid driver head.

BACKGROUND

Golf is an outdoor sport played by many individuals for recreational and competitive purposes on golf courses throughout the world. The golf game is played with a small ball that is struck by a club. Each golfer uses a set of clubs while playing golf where the set includes at least a driver, woods, irons and a putter. The golf club is comprised of three basic components, the grip, the shaft and the head. The head portion strikes the ball and accordingly the grip is the portion of the club that is held by the golfer's hand and the shaft extends between the head and the grip. The different clubs are used at different distances and depending on the lie of the ball on the golf course. A putter is used exclusively on or near the greens for putting a ball short distances to the hole. Irons vary in shaft length and loft angle and thus vary in distance that may be achieved with each club. Higher irons are used for shorter distances and lower irons are typically used for longer distances. If a golfer is a significant amount of distance from a hole a golfer may choose to use a fairway wood, which has a larger head. The one distinction between the iron and the wood club is particularly the head size and shape. Irons are angled from about 16 to 48 degrees with a sloping hitting surface. The angle and sloping surface enable the golfer to manipulate the distance and lift of the golf ball when striking it. The heads of the iron are usually made of steel or some other metal and forged by hammering hot metal under great pressure. A typical iron has a shorter shaft as compared to a wood because the iron is used for shorter distances and therefore less energy is transferred with a shorter shaft as opposed to the longer shaft of the typical wood.

A wood club has a larger head than an iron and most are designed to typically send the ball 200 yards or more. In general the driver is typically the largest wood in a set of clubs. The driver is used by a golfer to hit a ball off of a tee at the beginning of a hole. The shaft of the wood club is generally considerably longer than the irons. The greater length of the wood clubs increases the power transferred to the ball. However the club driver can be more difficult to swing because of an increased likelihood that the wood club does not hit the ball with the designated sweet spot of the wood club. The wood club's sweet spot is generally positioned in the middle of the club face. The sweet spot is generally the optimum position to strike the ball with the wood club.

Various designers have used different techniques to improve the likelihood of a golfer hitting the sweet spot when swinging a driver. Heavier club heads were used to resist twisting. Use of different weight techniques such as a center weighting or perimeter weighting of the wood club head have also been used to assist the golfer in achieving a more perfect swing. In general, a lighter head can be swung at a greater speed and may generate more energy to transfer the ball. However the golfer must be careful to maintain the club in a straight position when striking the ball. Many drivers have a large head and many with modern designed drivers have exaggerated large heads that are made of steel, titanium, bronze or other metals. The driver head shape allows the head to glide over the grass and ground rather than digging into the turf. Most initial drives at the beginning of a hole are made with a tee that is used to elevate the ball above the ground level.

A third type of club has been developed over the recent years to assist golfers in replacing some of the longer irons that are typically difficult to consistently hit with accuracy. Golf designers have determined that many irons with about a 24-degree loft or less and about a 38 inch length or greater may be difficult to hit consistently by the average golfer. This generally equates to any iron longer than about a five iron. Hybrid golf clubs have been developed to replace the two, three, four irons to provide the golfer with a more reliable club to hit as opposed to the two, three, four irons. The typical hybrid club combines elements of iron and woods, which may help the golfer utilize these features to strike balls on the fairway that would otherwise be struck with a two, three or four iron. Consequently, hybrid clubs that are currently on the market are designed for striking the ball on the fairway during a shot after the tee shot.

There still remains a need to assist a golfer with their drive or their initial tee shot. As discussed above, various designs of wood clubs used for driving have been implemented. However, a hybrid club for driving remains non-existent for the golfer. Many golfers may be able to utilize a hybrid head for a driver that lightens the weight of the head and therefore provides an opportunity for the golfer to transfer more energy in the swing when driving a ball off the tee. The present hybrid clubs on the market again are used to replace irons therefore the loft angles associated with the hybrid club are usually above about 15 degrees, particularly because the hybrid club is used as a replacement club for irons as opposed to a replacement for a driver. Accordingly, alternative hybrid golf clubs may be desired.

SUMMARY

The present disclosure relates to a hybrid golf club head for producing accurate and long distance shots. The hybrid golf club head includes a body member having a hitting surface, a top surface, a toe end, a heel end, and a sole surface extending between the toe end and the heel end. The hybrid golf club head also includes a shaft attachment portion extending from the heel end upwardly and rearwardly therefrom away from the toe end, where the shaft attachment portion defines a shaft axis. The hitting surface is inclined at a predetermined angle with respect to the shaft axis. The hybrid golf club head includes a first Length B of the top surface near the shaft attachment portion and a second Length A of the top surface near the toe end, where the ratio of B to A is in a range from about 0.428 to about 0.75.

According to other embodiments, a hybrid golf club head includes a body member having a hitting surface, a top surface, a toe end, a heel end, and a sole surface extending between the toe end and the heel end. The hybrid golf club head also includes a shaft attachment portion extending from the heel end upwardly and rearwardly therefrom away from the toe end, the shaft attachment portion defining a shaft axis, wherein a first width of the top surface near the shaft attachment portion ranges from about ¾ inches to about 1 inch, and a second width of the top surface near the toe end ranges from about 1 inch to 1 & ⅝ inches. The hitting surface is inclined at a predetermined angle with respect to the shaft axis, and the length (L) of the hitting surface is in a range from about 3 inches to about 5 inches.

DETAILED DESCRIPTION

The present disclosure relates to a hybrid driver head that produces a low trajectory while resulting in a straight and distant shot suitable for driving a golf ball. The driver hybrid club head may be made of various materials such as a stainless steel alloy, titanium or an alloy thereof, aluminum or an alloy thereof, a steel alloy, iron or an alloy thereof, tungsten or an alloy thereof, and graphite, and may be attached to a shaft of a comparable to a conventional driver, three wood, five wood, two iron, three iron or four iron. This driver hybrid head club is unique in that it maintains a loft angle on the club face between 6 to 13 degrees. The driver hybrid head according to the present disclosure utilizes a loft angle in a range from about 6 degrees to about 13 degrees, including being a range from about 9 degrees to about 13 degrees, to allow a golfer to produce a low trajectory of a tee shot and therefore produces a straighter, longer and more consistent drive than a conventional wood club head. Many modern designs of driver heads have been getting increasingly larger. The hybrid golf club head of the present disclosure uses a comparatively smaller head that provides a suitable loft and a head striking surface that is shaped like an oversized iron for the portion of a head behind the striking surface.

Many modern hybrid clubs used presently have larger loft angles of 13 to 23 degrees and are specifically designed for replacing a players longer irons, for example irons two, three, four, and five. This increased loft angle of the hybrid club provides a higher trajectory that is usually used by a player as a recovery club when a ball in play is positioned in a rough area or in a difficult spot on the fairway. Embodiments according to the present disclosure include a driver hybrid head club, which may be used for teeing off or driving a golf ball as a replacement for the typical driver presently used.

Use of the driver hybrid head club according to the present disclosure allows the golfer to strike the ball but with more consistency as compared to a conventional driver club and creates the low trajectory suitable for driving. Further the golfer may transfer greater energy to the golf ball due to the smaller size of the head. Therefore a decrease in weight of the driver hybrid golf club head may be realized.

Figure 1:
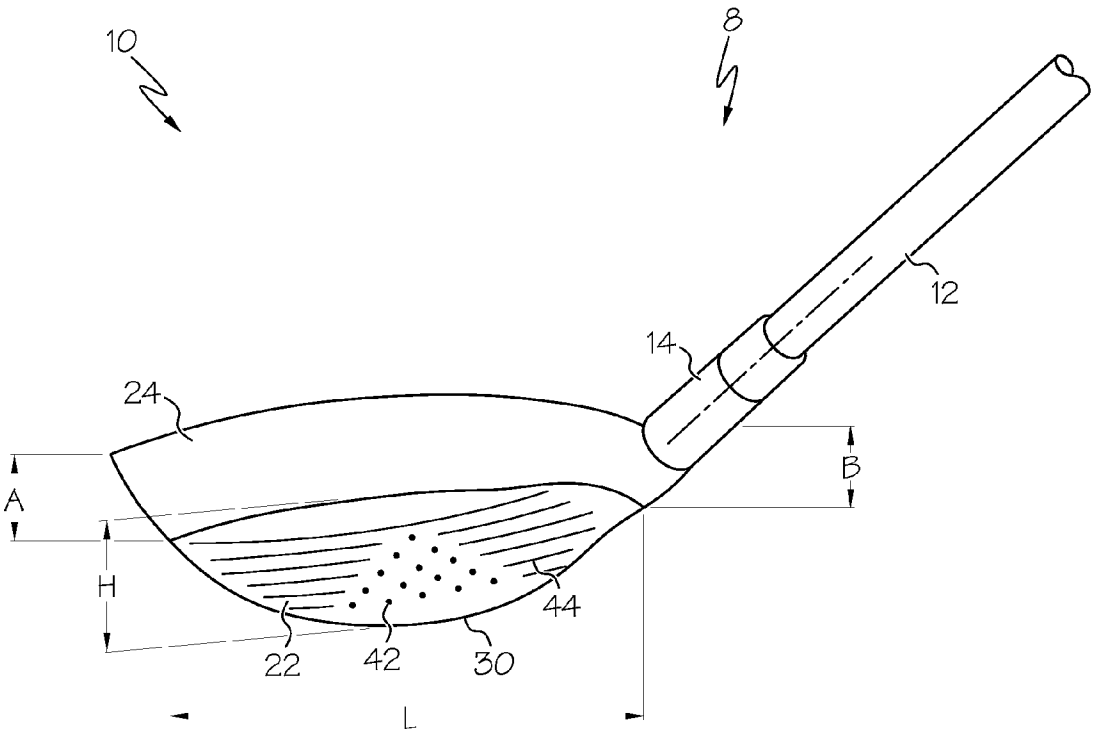
FIG. 1 depicts a front perspective view of the hybrid driver head according to one or more embodiments shown or described herein.

FIG. 1 depicts the perspective view of a hybrid golf club 8 that includes a hybrid golf club head 10 according to the present disclosure. The hybrid golf club head 10 includes a hitting surface 22. The hybrid golf club head 10 includes the top surface 24 and a back side 26. Various measurements are provided at different positions on the hybrid golf club head 10 such as (L) which is measured from the point of intersection of the shaft to the toe of the hybrid golf club head 10 as shown. Another length (A) is depicted along the top surface 24 at the toe of the hybrid golf club head 10 and another prospective length (B) is depicted along the top surface 24 at the butt of the hybrid golf club head 10 proximate to the hosel 14. The hybrid golf club head 10 includes a loft, which is in a range from about 6 degrees to about 13 degrees, including in a range from about 9 degrees to about 13 degrees. This loft provides a suitable angle at the hitting surface 22 for driving a golf ball. The hybrid golf club head 10 is attached to a shaft 12 through the hosel 14. The hybrid golf club head 10 may be attached to the shaft 12 in any suitable manner as known and used in the art such as using adhesive cements, welding, soldering, mechanical connectors such as threads, and other retaining elements. The length of the shaft 12 may be selected for certain embodiments such that the length of the shaft would be comparable to the length of a typical driver. Drivers may have a length that is about 43 to 44 inches long. However the hybrid golf club head 10 may be incorporated with shorter length shafts where the shaft may be as short as about 38 inches, which is comparable to a typical four iron, ranging to a 43-inch length, which is comparable to a typical three wood or driver.

Figure 2:
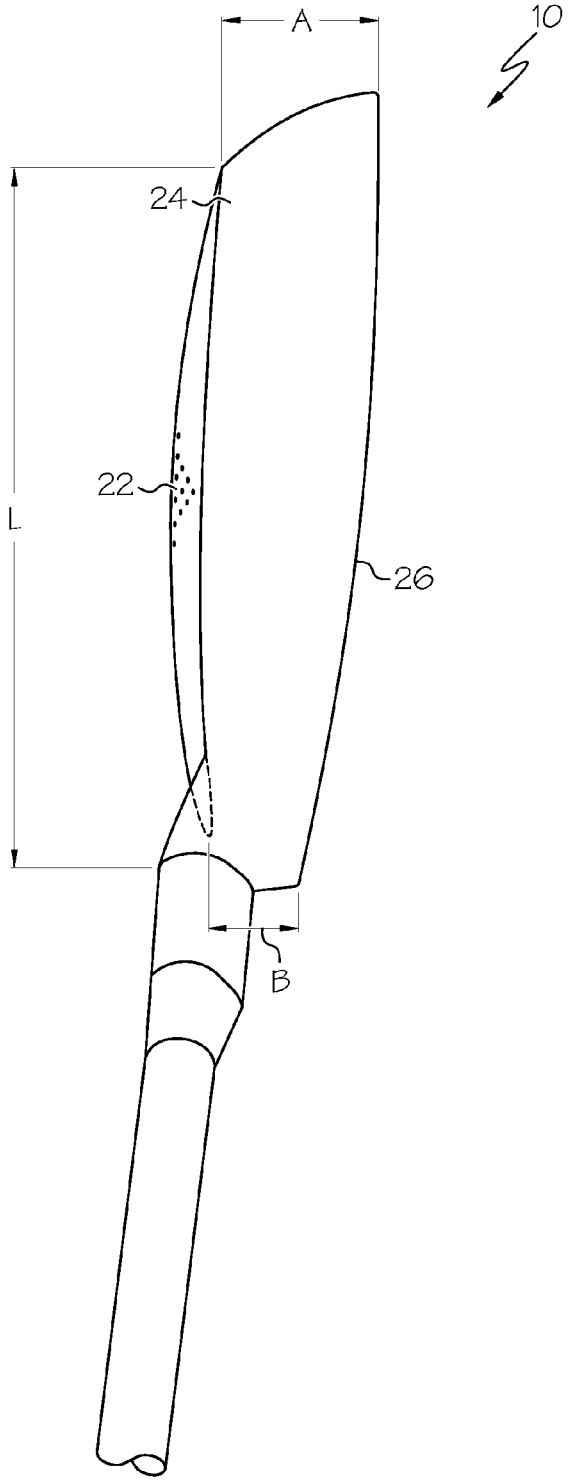
FIG. 2 depicts the top view of the hybrid head according to one or more embodiments shown or described herein.
Figure 3:
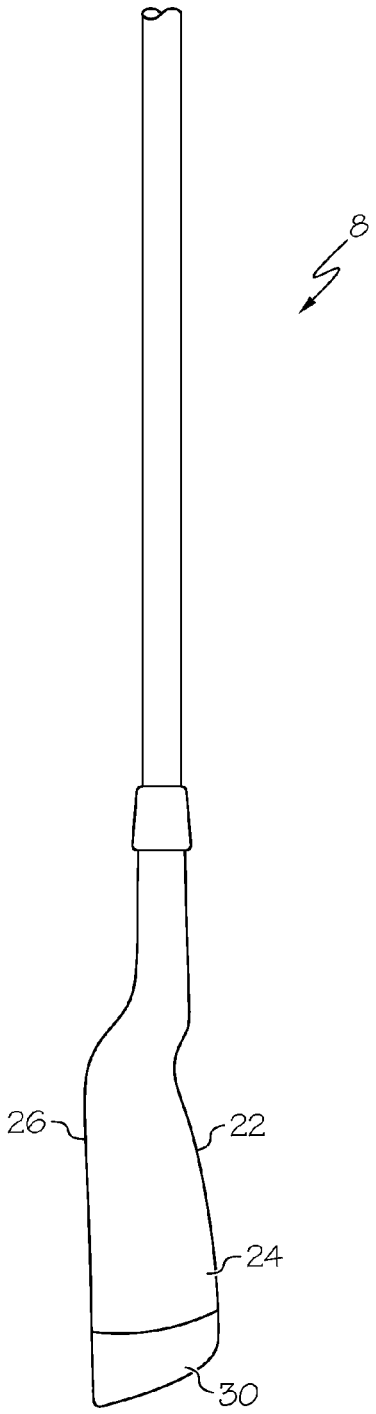
FIG. 3 depicts the front view as seen from the toe end of the hybrid head according to one or more embodiments shown or described herein.
Figure 4:
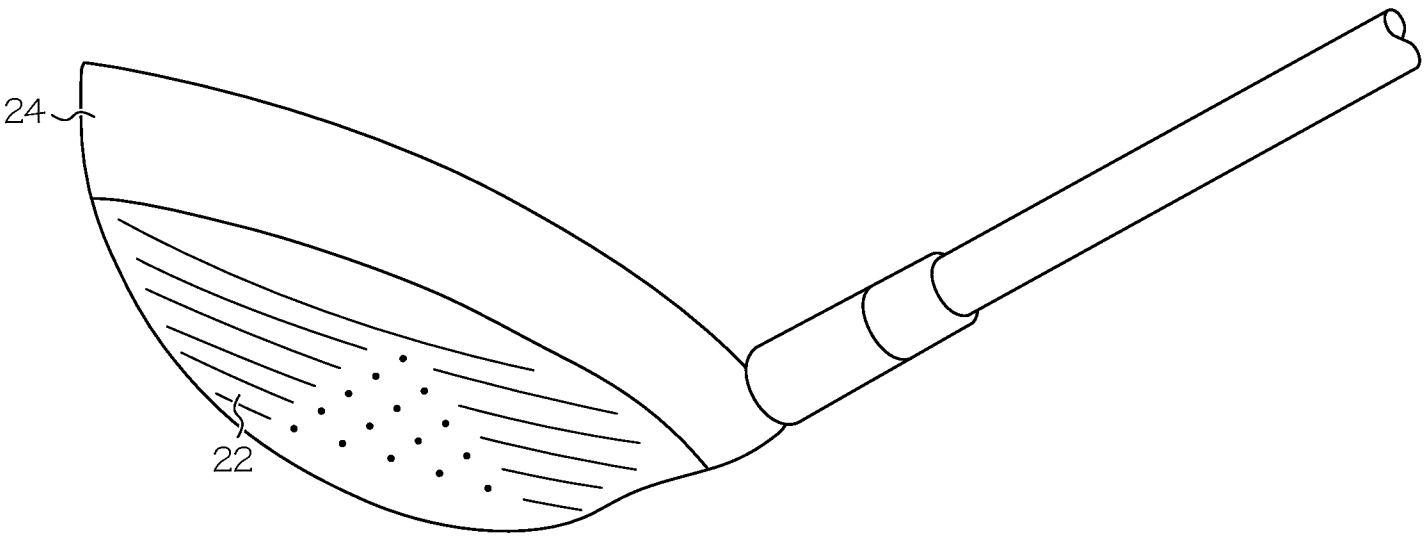
FIG. 4 depicts yet another perspective view of the hybrid head according to one or more embodiments shown or described herein.

FIG. 2 depicts a top view of the hybrid golf club head 10 and provides a more clear view of the Length A proximate to the toe of the hybrid golf club head 10 and Length B proximate to the butt of the hybrid golf club head 10, both measurements corresponding to the distance between the hitting surface 22 and the back side 26, evaluated along the top surface 24 of the hybrid golf club head 10. The distance between the hitting face 22 and the back side 26 evaluated along the top surface 24 may be equal to or smaller than Length A, such that the maximum distance between the hitting face 22 and the backside 26 is equal to Length A. Also the hitting surface 22 on one side and the back side 26 opposite the hitting surface 22 are depicted. It is noted that the back side 26 may have a slope or slightly angled shape that is comparable to an iron. However it is noted that the Length A is comparably short, similar to a conventional hybrid club that is used to replace an iron. The particular hybrid golf club head 10 includes a loft angle that is suitable and conducive for driving. FIG. 3 depicts yet another view of the hybrid golf club head 10 according to the present disclosure and FIG. 4 provides yet another prospective view of the hybrid golf club head 10 according to the present disclosure. It is noted that the hitting surface 22 may include a plurality of horizontal grooves 40 that are debossed into the hitting surface 22 and a plurality of dimples 42 that are debossed into the hitting surface 22, thereby illustrating a designated sweet spot. Due to the size of the hybrid driver club head according to the present disclosure, a golfer may be likely to have a controlled swing and more likely to hit the sweet spot of the hitting surface 22 than use of a club having a conventional design.

In some embodiments, the Length A is in a range from about 1 inch to about 3½ inches, including being in a range from about 1 inch to about 1⅝ inches. In some embodiments, Length B is in a range from about ¾ inches to about 1½ inches, including being in a range from about ¾ inches to about 1 inch. In these embodiments, the ratio of Length B to Length A may be in a range from about 0.428:1 to about 0.75:1, including being in a range from about 0.615:1 to about 0.75:1.

In some embodiments, the maximum height H of the hybrid golf club head 10, measured as the greatest distance from the sole 30 to the top surface 24, may be in a range from about 1½ inches to about 3½ inches. In these embodiments, the ratio of height H to length B may be in a range from about 1:1 to about 4.667:1, including being in a range from about 2:1 to about 3.5:1, including being in a range from about 2:1 to about 2.33:1.

In some embodiments the club length L may be in a range from about 3 inches to about 5 inches. In these embodiments the ratio of length L to length B may be in a range from about 2:1 to about 6.667:1 including being in a range from about 3.33:1 to about 5:1 including being in a range from about 4:1 to about 5:1.

In one embodiment provided as an illustration and without limitation, the hybrid golf club head 10 may include a Length A of about 1½ inches, a Length B of about 1 inch, a height H of about 1¾ inches, and a length L of about 4 inches such that the ratio of Length B to Length A is 0.667:1, the ratio of height H to length B is 1.75:1, and the ratio of length L to Length B is 4:1.

Embodiments of the hybrid golf club head 10 may be made from a variety of materials including, for example and without limitation, a stainless steel alloy, titanium or an alloy thereof, aluminum or an alloy thereof, a steel alloy, iron or an alloy thereof, tungsten or an alloy thereof, and graphite. In some embodiments, the hybrid golf club head 10 may be made in a composite construction that combines multiple materials to produce an integrated hybrid golf club head 10. In these embodiments, the various materials may modify the center of gravity of the hybrid golf club head 10, which may improve usability of the hybrid golf club head 10 for users.

Embodiments of the hybrid golf club head 10 according to the present disclosure may have a variety of weights. In general, the weight of the hybrid golf club head 10 may increase with decreasing loft angle. In embodiments according to the present disclosure, the hybrid golf club head 10 may have a weight in a range from about 185 grams to about 500 grams.

While depiction of the hybrid golf club head 10 illustrates configurations of the hybrid golf club head 10 which are intended for use by a right-handed golfer. It should be understood that the hybrid golf club head 10 having feature that are mirrored from those depicted in the appended figures may be suitable for a left-handed golfer, without departing from the scope of the present disclosure.

The design of the hybrid golf club head 10 enables the golfer to hit balls more consistently as opposed to the traditional wood head that is used for a driver. Further the hybrid golf club head 10 may be utilized in various shaft lengths however is still capable of providing a drive of sufficient distance for the user. Use of the hybrid golf club head 10 according to the present disclosure may be able to produce drives upwards to 300 yards comparable to any traditional wood head presently known in the art. Further the driver head according to the present disclosure is utilized as a driver as opposed to a recovery club as known with the hybrid clubs in the art. The driver club head according to the present disclosure is designed to weigh between 185 grams and 500 grams. Furthermore, the hybrid driver club head according to the present disclosure utilizes a suitable loft for driving a golf ball and provides a more accurate and consistent means to drive a ball off a tee. The instant disclosure has been shown and described in what it considers to be one practical embodiment. It is recognized, however, that departures may be made there from within the scope of the disclosure and that obvious modifications will occur to a person skilled in the art.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A hybrid golf club head comprising:

a body member having a hitting surface, a top surface, a toe end, a heel end, a back side, and a sole surface extending between the toe end and the heel end, and a shaft attachment portion extending from the heel end upwardly and rearwardly therefrom away from the toe end, the shaft attachment portion defining a shaft axis, wherein a first Length B of the top surface from the back side to the hitting surface evaluated at the shaft attachment portion ranges from about ¾inches to about 1½ inches, and a second Length A of the top surface from the back side to the hitting surface evaluated at the toe end ranges from about 1 inch to about 3½ inches, wherein a ratio of the first Length B to the second Length A is in a range from about 0.615 to about 0.75; and wherein the hitting surface is inclined at a predetermined angle with respect to the shaft axis, further wherein the length (L) of the hitting surface is in a range from about 3 inches to about 5 inches.

2. The hybrid golf club head of claim 1, wherein the predetermined angle ranges from about 6 degrees to about 13 degrees.

3. The hybrid golf club head of claim 1, wherein the hitting surface comprises a plurality of horizontal grooves debossed into the hitting surface.

4. The hybrid golf club head of claim 1, wherein the club head is made from at least one of a stainless steel alloy, titanium or an alloy thereof, aluminum or an alloy thereof, a steel alloy, iron or an alloy thereof, tungsten or an alloy thereof, and graphite.

5. The hybrid golf club head of claim 1, where a weight of the club head ranges from about 185 grams to about 500 grams.

6. The hybrid golf club head of claim 1, wherein a ratio of the length L to the first Length B is in a range from about 4 to about 6.

7. The hybrid golf club head of claim 6, wherein a maximum distance between the hitting surface and a back side of the body member evaluated along the top surface of the body member is equal to Length A.

* * * * *